US006315612B1

(12) United States Patent
Marchini et al.

(10) Patent No.: US 6,315,612 B1
(45) Date of Patent: Nov. 13, 2001

(54) CARRIER, PRIMARILY FOR LIGHT EMITTING DIODE

(75) Inventors: Barry Allen Marchini, Surrey; John Leonard Scriven, Kent, both of (GB)

(73) Assignee: Starpoint Electrics Limited, Surrey (GB)

( * ) Notice: Subject to any disclaimer, the term of this patent is extended or adjusted under 35 U.S.C. 154(b) by 0 days.

(21) Appl. No.: 09/485,098

(22) PCT Filed: Aug. 6, 1998

(86) PCT No.: PCT/GB98/02364

§ 371 Date: Feb. 22, 2000

§ 102(e) Date: Feb. 22, 2000

(87) PCT Pub. No.: WO99/08345

PCT Pub. Date: Feb. 18, 1999

(30) Foreign Application Priority Data

Aug. 6, 1997 (GB) ..... 9716693
Mar. 20, 1998 (GB) ..... 9806075

(51) Int. Cl.[7] ..... H01J 9/03
(52) U.S. Cl. ..... 439/619
(58) Field of Search ..... 362/226, 227, 362/249, 800; 439/56, 57, 619, 699.2

(56) References Cited

U.S. PATENT DOCUMENTS

| | | | | |
|---|---|---|---|---|
| 2,343,675 | * | 3/1944 | Kenyon . | |
| 3,206,713 | * | 9/1965 | Horan . | |
| 5,057,982 | | 10/1991 | Hanami | 362/226 |
| 5,160,200 | | 11/1992 | Cheslske | 362/249 |
| 5,378,158 | | 1/1995 | Owen | 439/57 |
| 6,109,764 | * | 8/2000 | Shu | 362/226 |

FOREIGN PATENT DOCUMENTS 2 145 577 A 3/1985 (GB) .

* cited by examiner

*Primary Examiner*—Brian Sircus
*Assistant Examiner*—Thanh-Tam Le
(74) *Attorney, Agent, or Firm*—Sughrue, Mion, Zinn, Macpeak & Seas, PLLC

(57) ABSTRACT

A carrier (10) comprises a body (12) and a pair of holes (14) which extend through the body (12) away from a face (16) against which a light emitting diode may be placed towards a pair of supports (18) over which respective lead wires of the light emitting diode may be bent thereby enabling a light emitting diode to simulate a wedge based lamp in allowing direct push contact of the filament lead wires with associated electrical circuitry.

9 Claims, 4 Drawing Sheets

78
80

80

86
88

78
80
84
82
70

84
72

88
74

90
92
76
20a
26a
10a

60

CARRIER, PRIMARILY FOR LIGHT EMITTING DIODE

Many products are fitted with so-called wedge based lamps whose filament lead wires emerge from glass to allow direct push contact of the filament lead wires with associated electrical circuitry.

There would be advantages, in terms of longer life and greater mechanical reliability, in utilising light emitting diodes rather than wedge based lamps.

An aim of the present invention, therefore, is to enable a light emitting diode to simulate a wedge based lamp in its connection with the associated electrical circuitry.

This aim is achieved by the provision of a carrier which, in accordance with the present invention, comprises a body and a pair of holes which extend through the body away from a face against which a light emitting diode may be placed towards a pair of supports over which respective lead wires of the light emitting diode may be bent.

Preferably, the carrier is shaped so that the face against which a light emitting diode is to be placed is generally planar, and manipulating the respective lead wires is then sufficient to hold the light emitting diode in place.

Preferably, the carrier is provided with a tubular member between the supports for facilitating the mounting of a pair of light emitting diodes in series and, preferably, the carrier is shaped so that a free end of each of the supports is formed with a respective groove.

It is desirable for the carrier to be provided with means for indicating the polarization of a light emitting diode.

The need to know the polarization of the light emitting diode arises from the need to avoid damage resulting from incorrect powering of the light emitting diode which would occur if the light emitting diode was incorrectly connected to its associated electrical circuitry.

It is therefore also desirable for the carrier to be provided with means for preventing incorrect mounting of the carrier.

In fact, in one arrangement, the means for indicating the polarization of the light emitting diode is further utilised as the means for preventing the incorrect mounting of the carrier.

More particularly, a protrusion provided by the carrier may both indicate the polarization of the light emitting diode and engage with either a keyway or an abutment provided by a component with which the carrier is to be associated.

A keyway could allow the carrier to be located in its then current orientation by allowing the protrusion to enter the keyway when correctly orientated whereas an abutment could prevent the carrier from being located in its then current orientation by abutment with the protrusion when incorrectly orientated.

In an alternative arrangement, said protrusion could be replaced by a slot or the like for engagement with a rib or the like on said associated component.

More generally, said protrusion could be supplemented or replaced by a part of the carrier such as a (further) slot or a (further) protrusion which is not primarily intended to indicate the polarization of the light emitting diode but is primarily intended to prevent incorrect mounting of the carrier with said associated component.

Thus, in a preferred arrangement, the protrusion primarily intended to indicate polarization is distinct from the protrusion primarily intended to prevent incorrect mounting.

Preferably, the carrier is integrally formed of an insulating material, for example by plastics moulding.

In many applications there are advantages in using light emitting diodes because they take much less power than lamps and there is therefor a lower drain on a power source such as a battery.

One very useful application would be to replace the hazard warning lights on a car or other vehicle. This may be a direct replacement for the indicator bulbs or be physically provided with the indicator bulbs but connected to the hazard warning system. Either way when the vehicle breaks down the hazard warning lights would flash with only minimal drain on the battery.

The fact that the carrier emulates a wedge based lamp means that there is a choice as to which to fit.

For instance, the less expensive models of a car could be fitted with wedge based lamps whereas the more expensive models could be fitted with light emitting diodes.

Another very useful application, again for cars or other vehicles, could be to replace the bulbs in an instrument panel by light emitting diodes on carriers, which would have the benefit of requiring simpler drive circuits as well as less power for the drive circuits.

Two carriers, in accordance with the present invention, will now be described in more detail, by way of example only, with reference to the accompanying drawings, in which.

Figure 1:
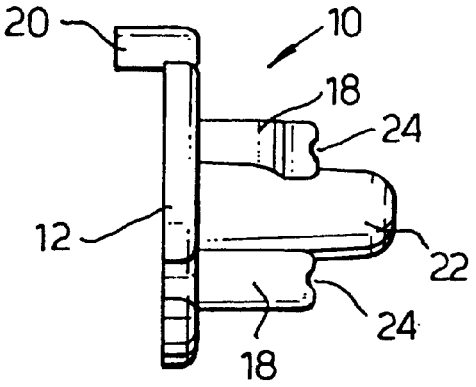
FIGS. 1 to 5 are, respectively, side, left end, right end, top and bottom views of a first carrier.
Figure 2:
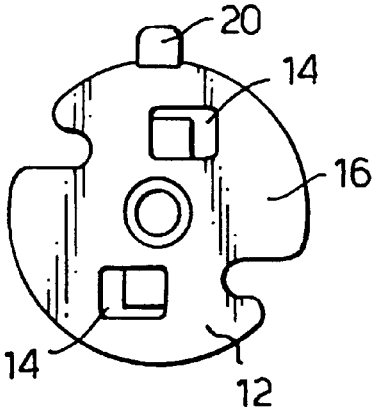
Figure 3:
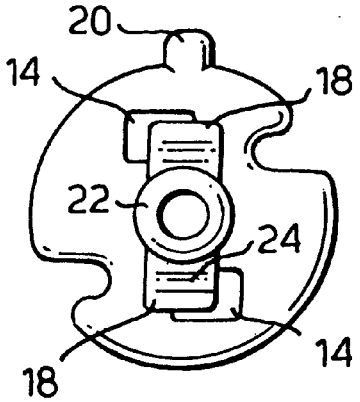
Figure 4:
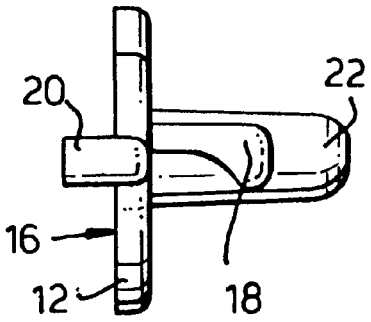
Figure 5:
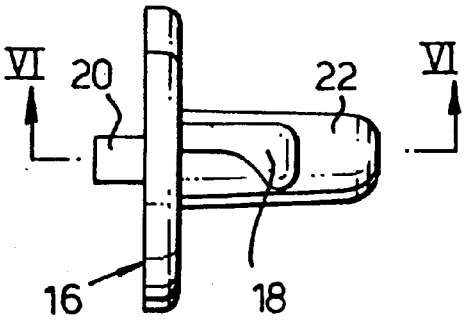
Figure 6:
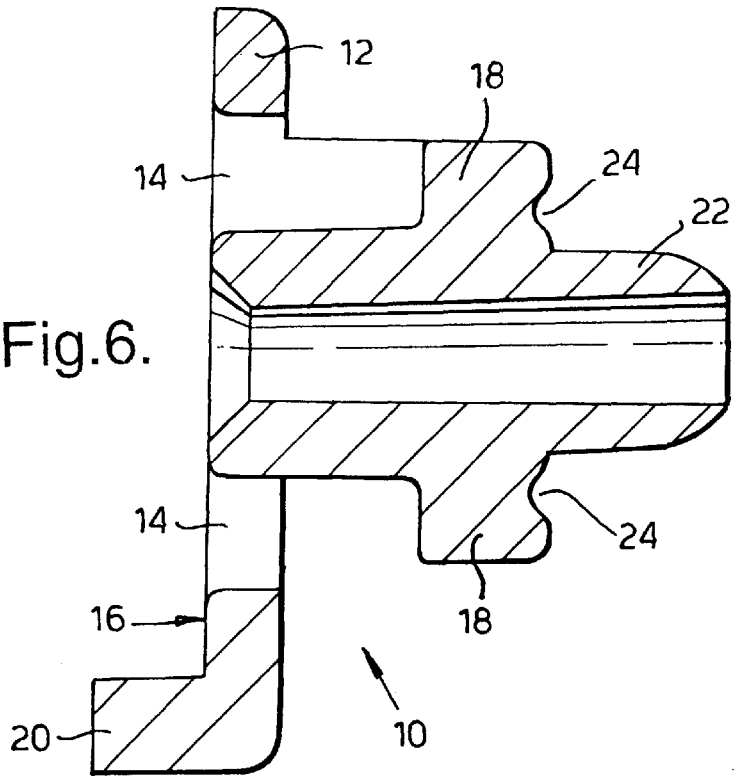
FIG. 6 is an enlarged cross-sectional view taken along the line VI—VI of FIG. 5.

In the accompanying drawings, FIGS. 1 to 8 show a carrier 10 which has been formed in one-piece of a plastics material to present a body 12 and a pair of holes 14 which extend through the body away from a face 16 against which a light emitting diode may be placed towards a pair of supports 18 over which respective lead wires on the light emitting diode may be bent.

The body 12 has a peg 20 for indicating the polarization of the light emitting diode.

The body 12 also has a central tube 22, located between and longer than the supports 18, for facilitating the mounting of a pair of light emitting diodes in series.

When the carrier 10 is to be used with a single light emitting diode, the flat face of the light emitting diode is placed against the flat face of the carrier 10, i.e. the face 16. The two lead wires of the light emitting diode are fed through respective ones of the two holes 14. The free ends of the two lead wires are then bent, in opposite directions, over the free ends of the two supports 18. The free ends of the two supports 18 may be formed with respective grooves 24. The grooves 24 help to maintain the lead wires in place and thus help to maintain the light emitting diode in place.

Figure 7:
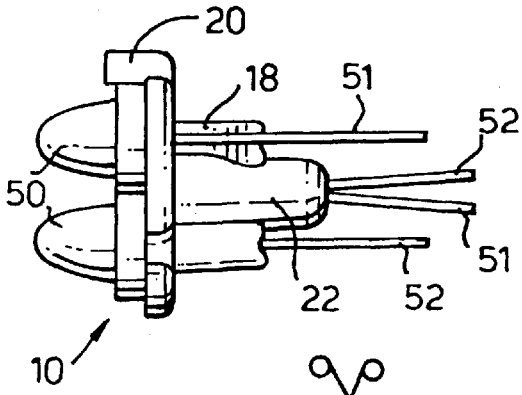
FIGS. 7 and 8 are, respectively, side and top views of the first carrier when associated with a pair of light emitting diodes in series.
Figure 8:
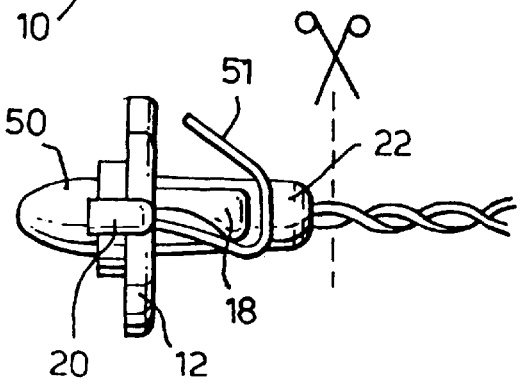
Figure 9:
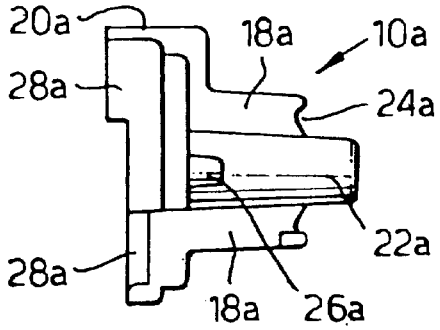
FIGS. 9 to 13 are, respectively, side, left end, right end, top and bottom views of a second carrier.
Figure 10:
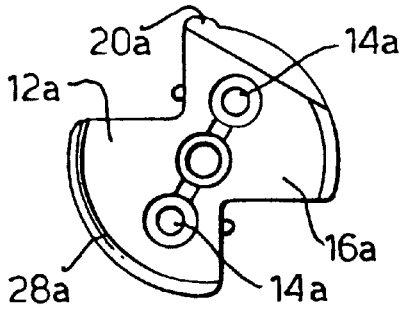
Figure 11:
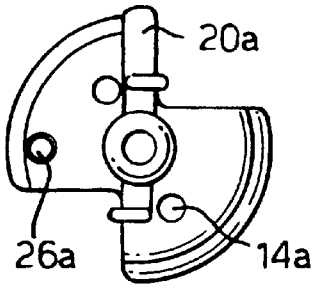
Figure 12:
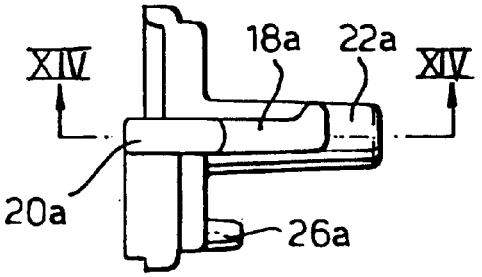
Figure 13:
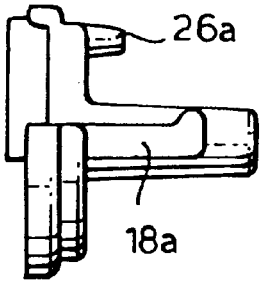
Figure 14:
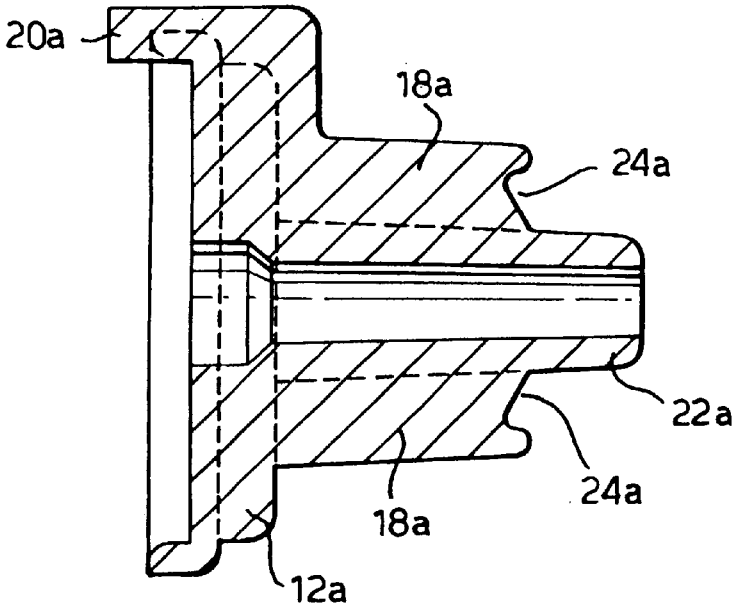
FIG. 14 is an enlarged cross-sectional view taken along the line XIV—XIV of FIG. 12.

The arrangement will be more clearly understood with reference to the use of the carrier 10 with a pair of light emitting diodes as shown in FIGS. 7 and 8.

Each of the light emitting diodes 50 is of a conventional construction and has a pair of lead wires 51,52 extending therefrom.

Both of the light emitting diodes 50 are mounted against the flat face 16. For one of the light emitting diodes 50, its lead wire 51 is fed through one of the holes 14 and its lead wire 52 is fed through the central tube 22. For the other of the light emitting diodes 50, its lead wire 51 is fed through the central tube 22 and its lead wire 52 is fed through the other of the holes 14. The lead wires 51,52 extending through the central tube 22 are then twisted and cut to make a series electrical connection between the two light emitting diodes 50.

The remaining lead wire 51 and the remaining lead wire 52 are then bent in opposite directions over the free ends of the adjacent supports 18.

In FIGS. 9 to 15, a second carrier is shown in which the reference numbers correspond to those of the first carrier but with the addition of the suffix "a".

Accordingly, it is merely necessary to confirm that the second (preferred) carrier 10*a* has again been formed in one-piece of a plastics material with a body 12*a*, a pair of holes 14*a*, a light emitting diode support face 16*a*, a pair of supports 18*a*, a peg 20*a*, a central tube 22*a* and grooves 24*a* in the supports 18*a*.

Now, however, the peg 20*a* is supplemented by a further peg 26*a* for use in helping to avoid incorrect mounting of the carrier 10*a* as well as a pair of flange-like walls 28*a* for use in helping to locate the light emitting diode.

Figures 15A, 15B, 15C, 15D, 15E, 15F, 15G, 15H, 15I, 15J:
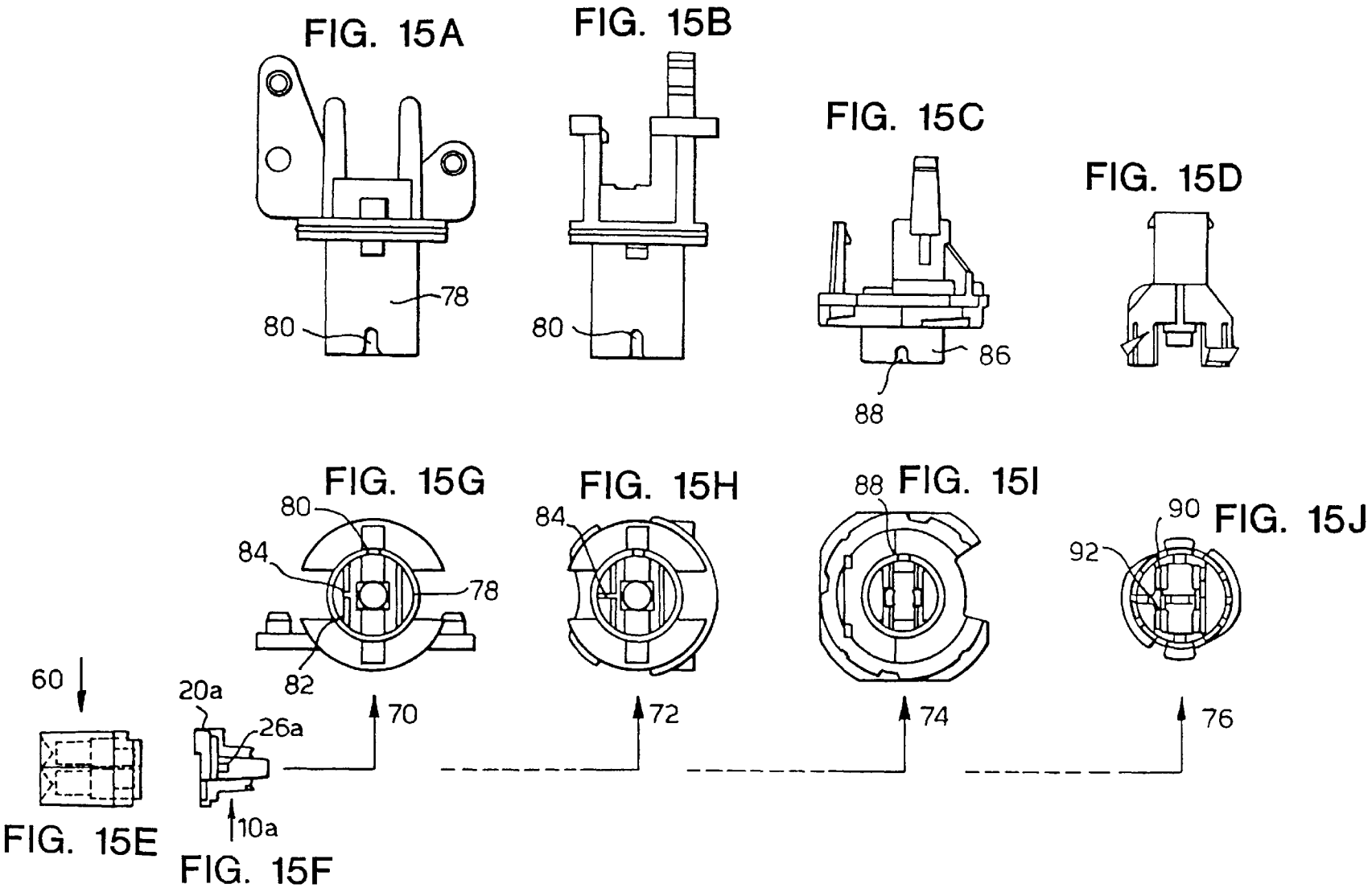
FIG. 15 schematically illustrates how the second carrier can be mounted to a series of associated electrical components, each shown in a side view and an end view.

As shown in FIG. 15, one face of the carrier 10*a* is to be fitted with the light emitting diode (which may optionally include a diffusing transparent lens cap 60) and the other face of the carrier 10*a* is to be fitted with any selected one of a series of associated electrical components such as lamp holders 70, 72, 74 and 76.

Lamp holder 70 is formed with a cylinder 78 having a slot 80 for receiving the peg 20*a* during correct insertion, and is formed with a strut 82 having a rib 84 for interfering with the peg 26*a* during incorrect insertion. If an attempt was made to insert the carrier 10*a* the wrong way round, it would be extremely difficult to force the peg 26*a* past the rib 84 even if the peg 20*a* could be forced into the cylinder 78.

Lamp holder 72 is effectively the same as the lamp holder 70—lamp holder 74 is formed with a cylinder 86 having a slot 88 for receiving the peg 20*a* and lamp holder 76 is formed with a strut 90 having a rib 92 for interfering with the peg 26*a*.

What is claimed is:

1. A carrier in combination with two light emitting diodes;

the carrier comprising a body having a face against which the two light emitting diodes are placed, having an opposed face provided with two supports and a hollow tubular member located between said two supports, and having three holes which extend through said body, with a first two of said holes being associated with respective ones of said two supports and with the third of said holes being associated with said hollow tubular member; and the two light emitting diodes each having a pair of lead wires, with one of said lead wires of each of said two light emitting diodes extending through a respective one of said first two holes and being bent over a respective one of said supports, and with the other of said lead wires of each of said light emitting diodes extending through the third of said holes and through said hollow tubular member and being twisted together to enable the two light emitting diodes to be mounted in series.

2. A combination according to claim 1, in which the face of the carrier against which the light emitting diodes are placed is generally planar.

3. A combination according to claim 1, in which a free end of each of the supports is formed with a respective groove.

4. A combination according to claim 1, in which means is provided for indicating the polarization of the light emitting diodes.

5. A combination according to claim 4, in which the means for indicating polarization comprises a protrusion.

6. A combination according to claim 1, in which means is provided for preventing incorrect mounting of the carrier.

7. A combination according to claim 6, in which the means for preventing incorrect mounting comprises a protrusion.

8. A combination according to claim 7, in which a protrusion primarily intended to indicate polarization is distinct from the protrusion primarily intended to prevent incorrect mounting.

9. A combination according to claim 1, in which the carrier is integrally formed of an insulating material.

* * * * *